US009824680B2

(12) United States Patent
Kim et al.

(10) Patent No.: US 9,824,680 B2
(45) Date of Patent: Nov. 21, 2017

(54) BEAMFORMING MODULE, ULTRASONIC IMAGING APPARATUS USING THE SAME, BEAMFORMING METHOD USING THE BEAMFORMING MODULE, AND METHOD OF CONTROLLING THE ULTRASONIC IMAGING APPARATUS USING THE BEAMFORMING MODULE

(71) Applicants: SAMSUNG ELECTRONICS CO., LTD., Suwon-si (KR); Industry Academic Cooperation Foundation, Hallym University, Chuncheon-si (KR)

(72) Inventors: Kyu Hong Kim, Seongnam-si (KR); Yun Tae Kim, Hwaseong-si (KR); Sung Chan Park, Suwon-si (KR); Su Hyun Park, Hwaseong-si (KR); Joo Young Kang, Yongin-si (KR); Jung Ho Kim, Yongin-si (KR); Moo Ho Bae, Seoul (KR)

(73) Assignees: SAMSUNG ELECTRONICS CO., LTD., Suwon-si (KR); Industry Academic Cooperation Foundation, Hallym University, Chuncheon-si (KR)

( * ) Notice: Subject to any disclaimer, the term of this patent is extended or adjusted under 35 U.S.C. 154(b) by 688 days.

(21) Appl. No.: 14/152,026

(22) Filed: Jan. 10, 2014

(65) Prior Publication Data

US 2014/0198621 A1 Jul. 17, 2014

(30) Foreign Application Priority Data

Jan. 11, 2013 (KR) ..... 10-2013-0003268

(51) Int. Cl.

| | |
|---|---|
| ***G10K 13/00*** | (2006.01) |
| ***G10K 11/34*** | (2006.01) |
| ***B06B 1/06*** | (2006.01) |

(52) U.S. Cl.

CPC ..... *G10K 11/348* (2013.01); *B06B 1/0633* (2013.01); *G10K 11/346* (2013.01)

(58) Field of Classification Search

USPC ..... 367/137

See application file for complete search history.

(56) References Cited

U.S. PATENT DOCUMENTS

| | | | | |
|---|---|---|---|---|
| 6,436,044 | B1 | 8/2002 | Wang | |
| 6,468,216 | B1 | 10/2002 | Powers et al. | |
| 7,099,630 | B2 * | 8/2006 | Brunner | H04B 7/065 455/562.1 |
| 8,666,197 | B2 * | 3/2014 | Kim | A61B 8/08 382/128 |

(Continued)

FOREIGN PATENT DOCUMENTS

| | | | |
|---|---|---|---|
| KR | 10-2007-0089101 | A | 8/2007 |
| KR | 10-2012-0095730 | A | 8/2012 |
| KR | 10-2013-0054743 | A | 5/2013 |

*Primary Examiner* — James Hulka

(74) *Attorney, Agent, or Firm* — Sughrue Mion, PLLC

(57) ABSTRACT

A beamforming module includes a conversion unit configured to convert an input signal to generate a converted signal using at least one conversion function, a weight calculator configured to calculate a converted signal weight as a weight for the converted signal, and a synthesizer configured to generate a result signal using the converted signal and the converted signal weight.

18 Claims, 14 Drawing Sheets

(56) References Cited

U.S. PATENT DOCUMENTS

| | | | | |
|---|---|---|---|---|
| 8,675,445 | B2 * | 3/2014 | Kim | G01S 7/52047 367/7 |
| 9,161,739 | B2 * | 10/2015 | Kim | A61B 8/14 |
| 2002/0028009 | A1 * | 3/2002 | Pomata | G01S 15/8963 382/131 |
| 2003/0109226 | A1 * | 6/2003 | Brunner | H04B 7/0634 455/69 |
| 2007/0167802 | A1 * | 7/2007 | Rigby | G01S 7/52046 600/459 |
| 2009/0141957 | A1 * | 6/2009 | Yen | G01S 7/52047 382/131 |
| 2009/0198138 | A1 * | 8/2009 | Uchikawa | A61B 8/00 600/453 |
| 2009/0241673 | A1 * | 10/2009 | Kondo | G01N 29/0672 73/625 |
| 2012/0269408 | A1 * | 10/2012 | Kim | A61B 8/08 382/128 |
| 2012/0275261 | A1 * | 11/2012 | Kim | G01S 7/52047 367/7 |
| 2013/0131514 | A1 * | 5/2013 | Kim | A61B 8/14 600/443 |

* cited by examiner (a) (b) (c)

BEAMFORMING MODULE, ULTRASONIC IMAGING APPARATUS USING THE SAME, BEAMFORMING METHOD USING THE BEAMFORMING MODULE, AND METHOD OF CONTROLLING THE ULTRASONIC IMAGING APPARATUS USING THE BEAMFORMING MODULE

CROSS-REFERENCE TO RELATED APPLICATION(S)

This application claims priority from Korean Patent Application No. 2013-0003268, filed on Jan. 11, 2013, in the Korean Intellectual Property Office, the disclosure of which is incorporated herein in its entirety by reference.

BACKGROUND

1. Field

Apparatuses and methods consistent with exemplary embodiments relate to a beamforming module, a beamforming method, an ultrasonic imaging apparatus, and a method of controlling the ultrasonic imaging apparatus.

2. Description of the Related Art

An ultrasonic imaging apparatus is used to acquire a sectional image of various tissues or structures inside an object, for example, a human body, such as a sectional image of soft tissues and an image of blood flow using ultrasonic waves. The ultrasonic imaging apparatus is relatively small in size, inexpensive, displays an image in real time, and is inherently safe as there is no radiation exposure as in an X-ray imaging apparatus, and thus, has been extensively used for diagnosis of, for example, a heart, an abdomen, and a urinary system and in obstetrics and gynecology.

The ultrasonic imaging apparatus radiates ultrasonic waves toward a target region of an object and collects ultrasonic echo signals reflected from the target region to acquire an ultrasonic image based on the collected ultrasonic echo signals. To this end, the ultrasonic imaging apparatus performs beamforming to estimate a size of reflected waves of a predetermined space from a plurality of channel data based on the ultrasonic echo signals collected by an ultrasonic probe. Beamforming is a process including compensating for a time difference between ultrasonic waves input through a plurality of ultrasonic sensors, for example, transducers, applying predetermined weights to respective input ultrasonic signals, i.e., beamforming coefficients, to emphasize a signal at a predetermined position and to relatively attenuate a signal at another position, and focusing ultrasonic signals. Through beamforming, an ultrasonic imaging apparatus may generate an ultrasonic image suitable for examination of an internal structure of an object and display the ultrasonic image to a user.

Beamforming techniques may be classified into two categories, data-independent beamforming and adaptive beamforming, according to a beamforming coefficient used therein. The data-independent beamforming uses a weight that is determined regardless of an input ultrasonic signal. The adaptive beamforming determines an appropriate weight based on the input ultrasonic signal. Thus, according to the adaptive beamforming, weighting may vary in accordance with the input ultrasonic signal.

SUMMARY

One or more exemplary embodiments provide a beamforming module, an ultrasonic imaging apparatus, a beamforming method, and a method of controlling the ultrasonic imaging apparatus, in which calculation load and time for beamforming and resources used in a beamforming apparatus for beamforming are reduced.

In accordance with an aspect of an exemplary embodiment, a beamforming module includes a conversion unit configured to convert an input signal to generate a converted signal using at least one conversion function, a weight calculator configured to calculate a converted signal weight for the converted signal, and a synthesizer generating a result signal using the converted signal and the converted signal weight. The converted signal weight may be a weight applied to the at least one conversion function to calculate an optimal input signal weight for the input signal. In addition, the conversion function may reduce dimensions of the input signal.

The weight calculator may calculate the converted signal weight for the converted signal based on the input signal and the at least one conversion function. The weight calculator may calculate the converted signal weight for the converted signal using Equation 1 below, wherein β represents the converted signal weight, $R_1$ represents a covariance of the input signals, and $v_1$ represents a steering vector.

$$\beta = \frac{R_1^{-1} v_1}{v_1^H R_1^{-1} v_1} \quad \text{[Equation 1]}$$

In this case, the covariance $R_1$ may be a converted covariance of the input signals using Equation 2 below, wherein V represents the at least one conversion function and R represents a covariance of the input signals.

$$R_1 = V^H R V \quad \text{[Equation 2]}$$

The steering vector $v_1$ may be a converted steering vector obtained using the at least one conversion function v.

The converted signal generated by the conversion unit may be acquired using Equation 3 below, wherein u represents the converted signal, V represents a conversion function, and x represents the input signal.

$$u = V^H x \quad \text{[Equation 3]}$$

The result signal generated by the synthesizer may be acquired using Equation 4 below, wherein u represents the converted signal and β represents the converted signal weight.

$$z = \beta^H u \quad \text{[Equation 4]}$$

Here, the converted signal weight may be calculated using Equation 1 below, wherein $R_1$ represents a converted covariance of the input signals, and $v_1$ represents a converted steering vector.

$$\beta = \frac{R_1^{-1} v_1}{v_1^H R_1^{-1} v_1} \quad \text{[Equation 1]}$$

The at least one conversion function may be generated by combination of basis vectors acquired by performing principle component analysis on an optimal input signal weight for the input signal, the optimal input signal weight being calculated through a minimum variance technique. Here, the plurality of basis vectors may be perpendicular to each other. Particularly, the at least one orthogonal basis vector may be at least one from among an eigenvector or a Fourier basis vector.

In accordance with an aspect of another exemplary embodiment, an ultrasonic imaging apparatus includes an ultrasonic probe unit configured to radiate ultrasonic waves to an object, receive ultrasonic echo signals reflected from the object, and convert the received ultrasonic echo signals to output a plurality of ultrasonic signal, and a beamforming unit configured to convert the plurality of ultrasonic signals into a plurality of converted ultrasonic signals using at least one conversion function and calculate converted ultrasonic signal weights for the plurality of converted ultrasonic signals to perform beamforming of the ultrasonic signals using the plurality of converted ultrasonic signals and the plurality of converted ultrasonic signal weights. The beamforming unit may correct a time difference between the plurality of ultrasonic signals output from the ultrasonic probe unit to generate a plurality of time difference-corrected ultrasonic signals and convert the plurality of time difference-corrected ultrasonic signals to generate a plurality of converted ultrasonic signals.

In accordance with an aspect of still another exemplary embodiment, a beamforming method includes converting an input signal to generate a converted signal using at least one conversion function, calculating a converted signal weight for the converted signal, and generating a result signal using the converted signal and the converted signal weight.

In accordance with an aspect of still another exemplary embodiment, a method of controlling an ultrasonic imaging apparatus includes acquiring a plurality of ultrasonic signals by radiating ultrasonic waves to a target region, receiving ultrasonic echo signals reflected from the target region, and converting the received ultrasonic echo signals, generating a plurality of time difference-corrected ultrasonic signals by correcting a time difference between the acquired plurality of ultrasonic signals, converting the plurality of time difference-corrected ultrasonic signals to generate a plurality of converted ultrasonic signals, calculating converted ultrasonic signal weights for the plurality of converted ultrasonic signals acquired through the conversion, and generating beamformed ultrasonic signals using the plurality of converted ultrasonic signals and the converted ultrasonic signal weights.

BRIEF DESCRIPTION OF THE DRAWINGS

These and/or other aspects will become more apparent and readily appreciated from the following description of exemplary embodiments, taken in conjunction with the accompanying drawings in which.

DETAILED DESCRIPTION

Figure 1:
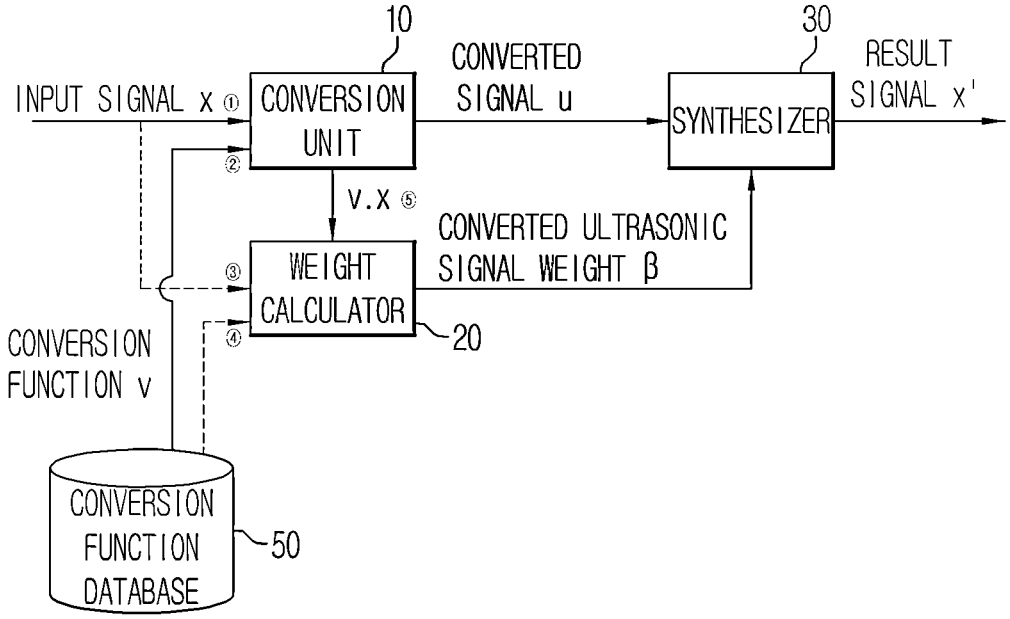
FIG. 1 is a block diagram illustrating a beamforming module according to an exemplary embodiment.

Reference will now be made in detail to the embodiments, examples of which are illustrated in the accompanying drawings, wherein like reference numerals refer to like elements throughout.

Hereinafter, beamforming modules according to exemplary embodiments will be described with reference to FIGS. 1 to 3.

FIG. 1 is a block diagram illustrating a beamforming module according to an exemplary embodiment. As illustrated in FIG. 1, the beamforming module includes a conversion unit 10, a weight calculator 20, and a synthesizer 30. The beamforming module may further include a conversion function database 50.

The conversion unit 10 converts an input signal x into a converted signal u, the weight calculator 20 calculates a weight β for the converted signal u, and the synthesizer 30 synthesizes the converted signal u and the weight β to generate a result signal x'. The conversion function database 50 includes at least one conversion function v used for signal conversion by the conversion unit 10 or weight calculation by the weight calculator 20.

Hereinafter, each of the constituent elements will be described in more detail.

Referring to FIG. 1, the conversion unit 10 receives the input signal x (①) from an external device (not shown) and converts the received input signal x by using a predetermined conversion function v to output the converted signal u.

According to an exemplary embodiment, the conversion unit 10 may convert the input signal x according to a conversion function v which is pre-defined by a user or a system designer. According to another exemplary embodiment, the conversion unit 10 may receive a conversion function v (②) for conversion of the input signal x from the conversion function database 50 and convert the input signal x using the received conversion function v. The converted signal u generated by the conversion unit 10 is transmitted to the synthesizer 30.

According to an exemplary embodiment, the conversion unit 10 may calculate the converted signal u using Equation 1 below.

$$u=V^{H}x \qquad \text{[Equation 1]}$$

In the Equation 1, x represents an input signal, V represents a predetermined conversion function, and u represents a converted signal acquired by converting the input signal x by using the conversion function v.

In an exemplary embodiment, the input signal x and the converted signal u may be expressed in an (A×B) matrix form. Here, A and B are natural numbers. For example, when B is 1, the input signal x and the converted signal u may be respectively expressed in an (A×1) matrix form as shown in Equations 2 and 3 below.

$$x = \begin{pmatrix} x_1 \\ x_2 \\ \cdots \\ x_m \end{pmatrix} \quad \text{[Equation 2]}$$

$$u = \begin{pmatrix} u_1 \\ u_2 \\ \cdots \\ u_n \end{pmatrix} \quad \text{[Equation 3]}$$

Here, m and n are positive integers. When the input signal x and the converted signal u are given as shown in Equations 2 and 3, respectively, the input signal x has dimensions of m×1, and the converted signal u has dimensions of n×1. The input signal x may include a plurality of input signals input through a plurality of channels. That is, the input signal x may be a group of input signals from a plurality of channels. In addition, the converted signal u may be a group of converted signals output via a plurality of channels. Each of elements of the matrices of the input signal x and the converted signal u as shown in Equations 2 and 3, i.e., $x_1$ to $x_m$ and $u_1$ to $u_n$ refers to each of the input signals respectively input through the channels or each of the converted signals respectively output through the channels. Each element of the matrices of the input signal x and the converted signal u may also be expressed in a predetermined matrix form, for example, a (1×a) matrix, a being a positive integer. As described above, when the input signal x and the converted signal u are expressed in a matrix form, dimensions thereof may be the same or different from each other.

In Equation 1, when an appropriate conversion function v is used, dimensions of the converted signal u may be smaller than that of the input signal x. For example, when the conversion function v is in an (M×N) matrix form, wherein M>N, and the input signal x is in an (M×1) matrix form, i.e., the input signal x has dimensions of M, the converted signal u calculated from the conversion function v and the input signal x is in an (N×1) matrix. Thus, the converted signal u has smaller dimensions than that of the input signal x. As described above, as the dimensions of the conversion function v or the input signal x decreases, calculation load may be relatively reduced, thereby facilitating a calculation process and reducing calculation time.

The conversion function v may be pre-defined. In this case, at least one conversion function v that may be applied to various input signals x may be pre-defined by calculating the conversion function v in advance based on various input signals x that may be acquired theoretically or based on experiments. The conversion function database 50 may be constructed based on the at least one pre-defined conversion function v.

Figure 2:
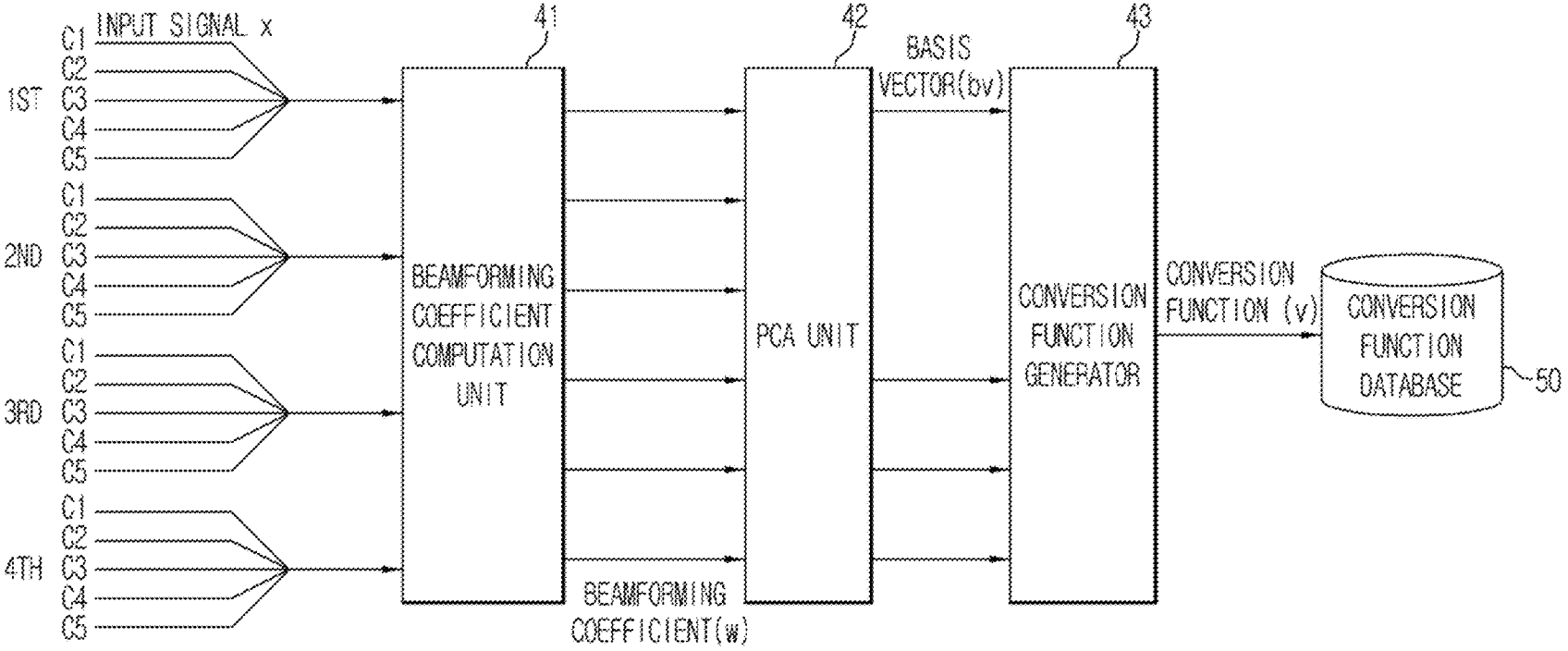
FIG. 2 is a diagram for explaining acquisition of a conversion function stored in a conversion function database.

FIG. 2 is a diagram for explaining acquisition of a conversion function stored in a conversion function database. FIG. 2 illustrates that a conversion function for calculation of an appropriate (e.g., optimal) beamforming coefficient is defined and stored in the conversion function database 50.

As illustrated in FIG. 2, input signals x are input or to be input plural times through a plurality of channels, for example, channels C1 to C5. A beamforming coefficient computation unit 41 calculates an appropriate (e.g., optimal) beamforming coefficient w based on the input signals x which are input or to be input plural times through the channels C1 to C5.

The beamforming coefficient w is a weight applied to an input signal of, for example, an ultrasonic signal of an ultrasonic imaging apparatus, during beamforming to relatively emphasize an input signal from a predetermined channel or relatively attenuate an input signal from a predetermined channel, thereby focusing ultrasonic signals. That is, the beamforming coefficient w emphasizes or attenuates the input signal x input through a predetermined channel, for example, some or all of the input signals x input through the channels C1 through C5.

The beamforming coefficient computation unit 41 may calculate the beamforming coefficient w by use of, for example, a minimum variance technique. In this case, the beamforming coefficient w may be an appropriate (e.g., optimal) beamforming coefficient w* for beamforming of the input signal. Here, each of the optimal beamforming coefficients w* for each of the channels C1 to C5 or sub arrays thereof may be calculated.

The calculated beamforming coefficient w or w* may be expressed as a vector with predetermined dimensions.

A principle component analysis (PCA) unit 42 performs PCA upon the beamforming coefficient w or w* acquired by the beamforming coefficient computation unit 41 to reduce the dimensions of the beamforming coefficient w or w* expressed as a vector. The PCA involves extracting a variable or an axis capable of significantly expressing data when the data is expressed in a plurality of variables or axes. For example, when a distribution of the beamforming coefficient w or w is concentrated at particular regions, a significant error may not occur during beamforming when calculation is not carried out at regions where the beamforming coefficient w or w* is not distributed. Thus, when the particular regions where the beamforming coefficient w or w* is concentrated are extracted or regions where the beamforming coefficient w or w* is rarely distributed are removed, complexity of calculation regarding beamforming may be reduced and calculation load may be reduced.

The PCA unit 42 performs the principle component analysis upon the received beamforming coefficient w or w* to acquire at least one basis vector by. In an exemplary embodiment, a plurality of basis vectors by may be substantially perpendicular to each other for convenience of calculation. The basis vectors by that are substantially perpendicular to each other may be, for example, eigenvectors or Fourier basis vectors.

A conversion function generator 43 generates at least one conversion function v based on at least one basis vector by acquired by the PCA unit 42. In this case, a plurality of basis vectors by may be combined to generate the conversion function v. For example, the conversion function generator 43 may generate a predetermined conversion matrix by combining a plurality of basis vectors by. The number of the combined basis vectors by may be determined in accordance with predetermined setting stored in the conversion function generator 43 or may be arbitrarily determined by an external input from a user. The generated conversion function v is stored in the conversion function database 50. The conversion function v may be constituted with only one basis vector by. In this case, the basis vector by may be regarded as the conversion function v obtained without performing a separate combination process and stored in the conversion function database 50.

Various conversion functions v may be acquired for various input signals x using the aforementioned methods to construct the conversion function database 50.

The conversion unit 10 receives a predetermined conversion function v acquired according to the aforementioned methods from the conversion function database 50 and generates the converted signal u using the received conversion function v. In this case, the conversion function v may be a combination of a plurality of basis vectors by selected by the user from the basis vectors by stored in the conversion function database 50. That is, the conversion unit 10 may receive a plurality of basis vectors by while receiving the conversion function v and use the conversion function v generated by combination of the received basis vectors by for conversion of the input signal x.

The generated converted signal u is transmitted to the synthesizer 30 and combined with a converted signal weight β calculated by the weight calculator 20 which will be described below.

According to an exemplary embodiment, the conversion unit 10 may transmit at least one of the received input signals x and the conversion function v to the weight calculator 20.

The weight calculator 20 calculates the converted signal weight β that is a weight to be applied to the converted signal u output from the conversion unit 10. The weight calculator 20 may calculate the converted signal weight β for the converted signal u by use of one or both of the input signal x and the conversion function v. In this case, the weight calculator 20 may directly receive the input signal x from a signal generator (not shown) generating a signal such as a transducer or receive the conversion function v from the conversion function database 50 (③ and ④ of FIG. 1). Furthermore, the weight calculator 20 may also receive the input signal x or the conversion function v from the conversion unit 10 (⑤).

According to an exemplary embodiment, the weight calculator 20 calculates the converted signal weight β based on the input signal x and the conversion function v that is pre-determined by, for example, the user or received from the separate conversion function database 50 and transmits the generated converted signal weight β to the synthesizer 30.

In this case, the weight calculator 20 may calculate the converted signal weight β using Equation 4 below.

$$\beta = \frac{R^{-1}a}{a^H R^{-1} a} \quad \text{[Equation 4]}$$

In Equation 4, β represents a calculated converted signal weight. R represents a covariance of each of the input signals x respectively input through the plurality of channels. Here, a represents a steering vector.

The covariance R may be expressed by Equation 5 below.

$$R=E(XX^T) \quad \text{[Equation 5]}$$

In Equation 5, X represents a matrix of the aforementioned input signal x, for example, a (1×m) vector.

According to an exemplary embodiment, the covariance R may be a converted covariance $R_1$ obtained by converting the covariance R of the input signal x calculated using Equation 5, i.e., a converted covariance of the input signal x. In this case, the conversion function v received from the conversion function database 50 may be used for conversion of the covariance R. The converted $R_1$ covariance may be expressed by Equation 6 below.

$$R_1=V^H RV \quad \text{[Equation 6]}$$

The steering vector controls a phase of a signal. According to an exemplary embodiment, the steering vector a of Equation 4 may also be a converted steering vector $v_1$ similarly to the aforementioned covariance R. In this case, the same conversion function v used to convert the covariance R may be used to convert the steering vector a. Particularly, the converted steering vector $v_1$ may be calculated using Equation 7 below.

$$v_1=V^H a \quad \text{[Equation 7]}$$

The converted signal weight β may be calculated using Equation 8 below by inserting the converted covariance $R_1$ and the converted steering vector $v_1$ into Equation 4.

$$\beta = \frac{R_1^{-1} v_1}{v_1^H R_1^{-1} v_1} \quad \text{[Equation 8]}$$

The converted signal weight β is calculated using Equation 4 or Equation 8 described above. As illustrated in Equation 4 or Equation 8, the converted signal weight β may vary according to the input signal x as well as the conversion function v. The conversion function v may be calculated and defined in advance and may be selected in accordance with the input signal x. Thus, the converted signal weight β may vary according to the input signal x.

The converted signal weight β may be a predetermined column vector. When the conversion function v is expressed as an (M×N) matrix, the converted signal weight β is expressed as an (N×1) matrix, i.e., an (N×1) column vector.

The synthesizer 30 generates a result signal x' based on the converted signal u, which is generated by the conversion unit 10 and output therefrom, and the converted signal weight β calculated by the weight calculator 20. In this case, the synthesizer 30 may generate the result signal x' by combining the converted signal u and the converted signal weight R. For example, the result signal x' may be generated using the weighted sum of the converted signal u and the converted signal weight β. As a result, the beamforming module may generate and output the result signal x' from the predetermined input signal x via beamforming.

According to an exemplary embodiment, the synthesizer 30 may calculate the result signal x' based on the converted signal u and the converted signal weight β using Equation 9 below.

$$z=\beta^H u \quad \text{[Equation 9]}$$

In Equation 9, z represents the result signal x', β represents a converted signal weight calculated by the weight calculator 20, and u represents a converted signal acquired when the conversion unit 10 converts the input signal x.

Figure 3:
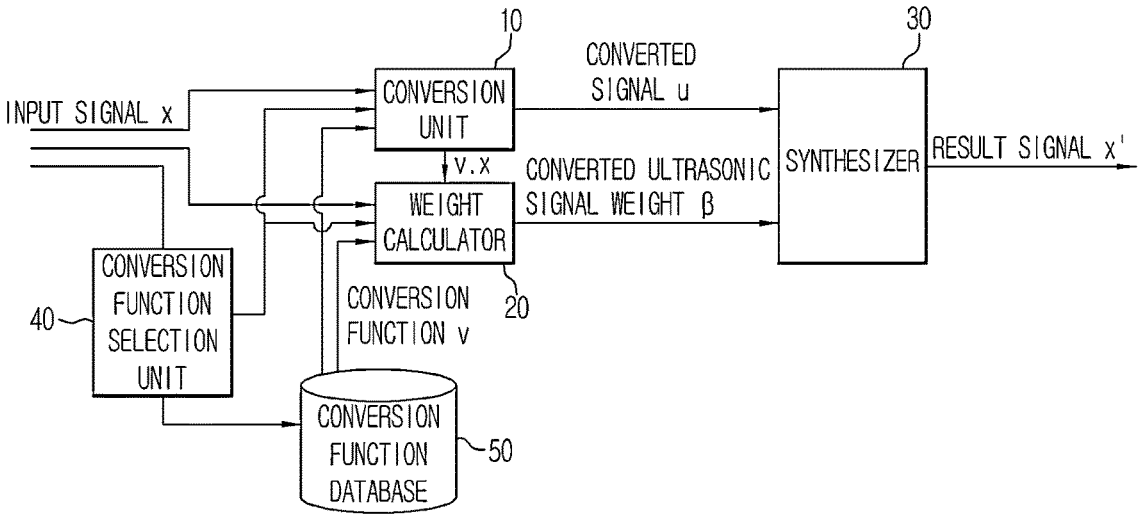
FIG. 3 is a block diagram illustrating a beamforming module according to another exemplary embodiment.

FIG. 3 is a block diagram illustrating a beamforming module according to another exemplary embodiment. As illustrated in FIG. 3, the beamforming module may further include a conversion function selection unit 40. The conversion function selection unit 40 selects at least one conversion function v among a plurality of conversion functions $v_1$ to $v_n$ (not shown) stored in the conversion function database 50. The selected conversion function v is transmitted to one of the conversion unit 10 and the weight calculator 20 or both.

The conversion function selection unit 40 may select at least one conversion function v according to a predetermined standard or an instruction input by the user. In this case, the conversion function selection unit 40 may select an appropriate conversion function v according to the input signal x.

Particularly, as illustrated in FIG. 3, the conversion function selection unit 40 receives the input signal x in the same manner as the conversion unit 10 or the weight calculator 20, analyzes the input signal x, and reads the conversion function database 50 to select an appropriate (e.g., optimal) conversion function v corresponding to the input signal x received among at least one conversion function stored in the conversion function database 50.

The conversion function selection unit 40 transmits information regarding the conversion function v selected using the aforementioned method to one of the conversion unit 10 and the weight calculator 20 or both. The conversion unit 10 or the weight calculator 20 or both may call the conversion function v from the conversion function database 50 in accordance with the received information regarding the conversion function v. Alternatively, the conversion function selection unit 40 may call the conversion function v from the conversion function database 50 and transmit the called conversion function v to one of the conversion unit 10 and the weight calculator 20 or both. The conversion unit 10 or the weight calculator 20 calculates the converted signal u or the converted signal weight β based on the received conversion function v and transmits the calculation result to the synthesizer 30.

Hereinafter, an ultrasonic imaging apparatus according to exemplary embodiments will be described with reference to FIGS. 4 to 11.

Figure 4:
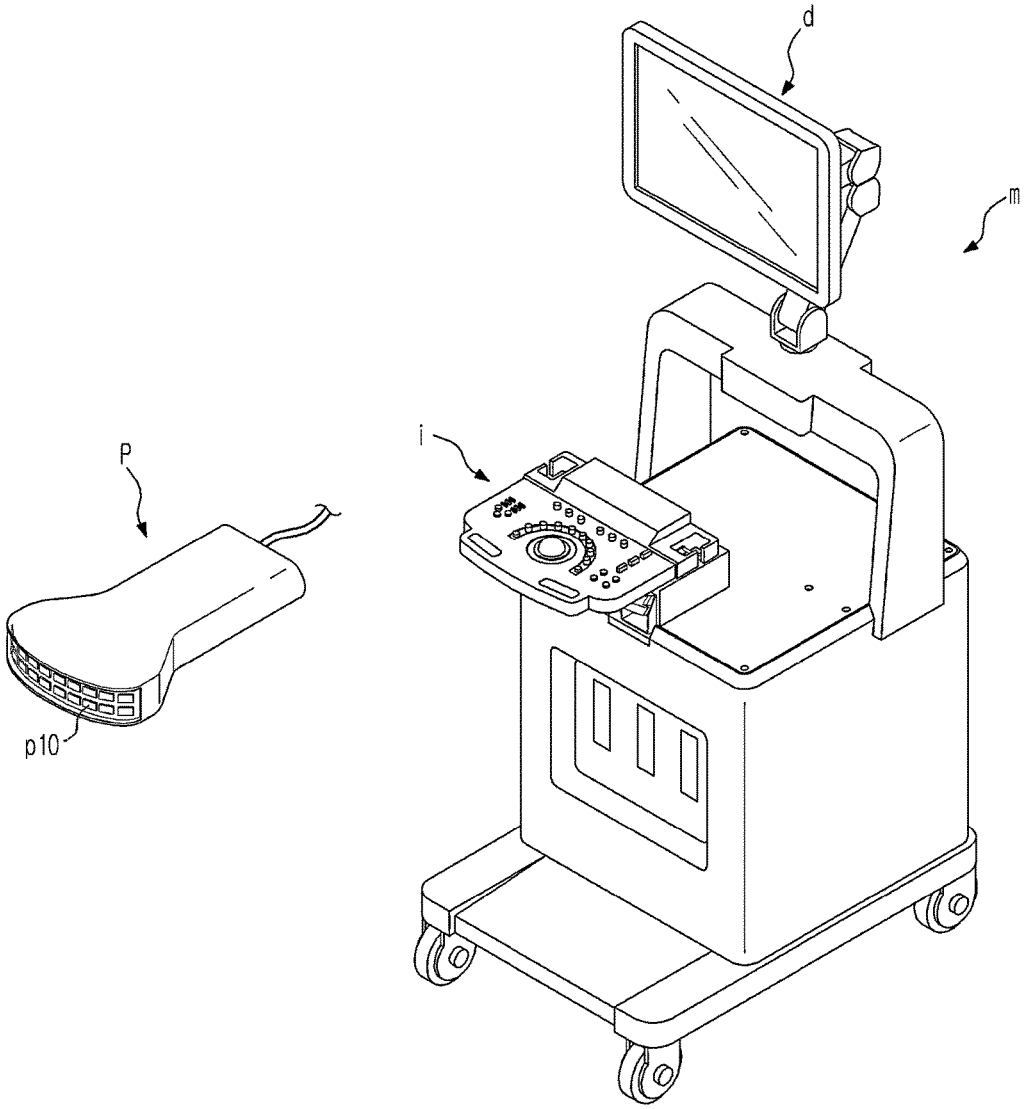
FIG. 4 is a perspective view illustrating an ultrasonic imaging apparatus according to an exemplary embodiment.
Figure 5:
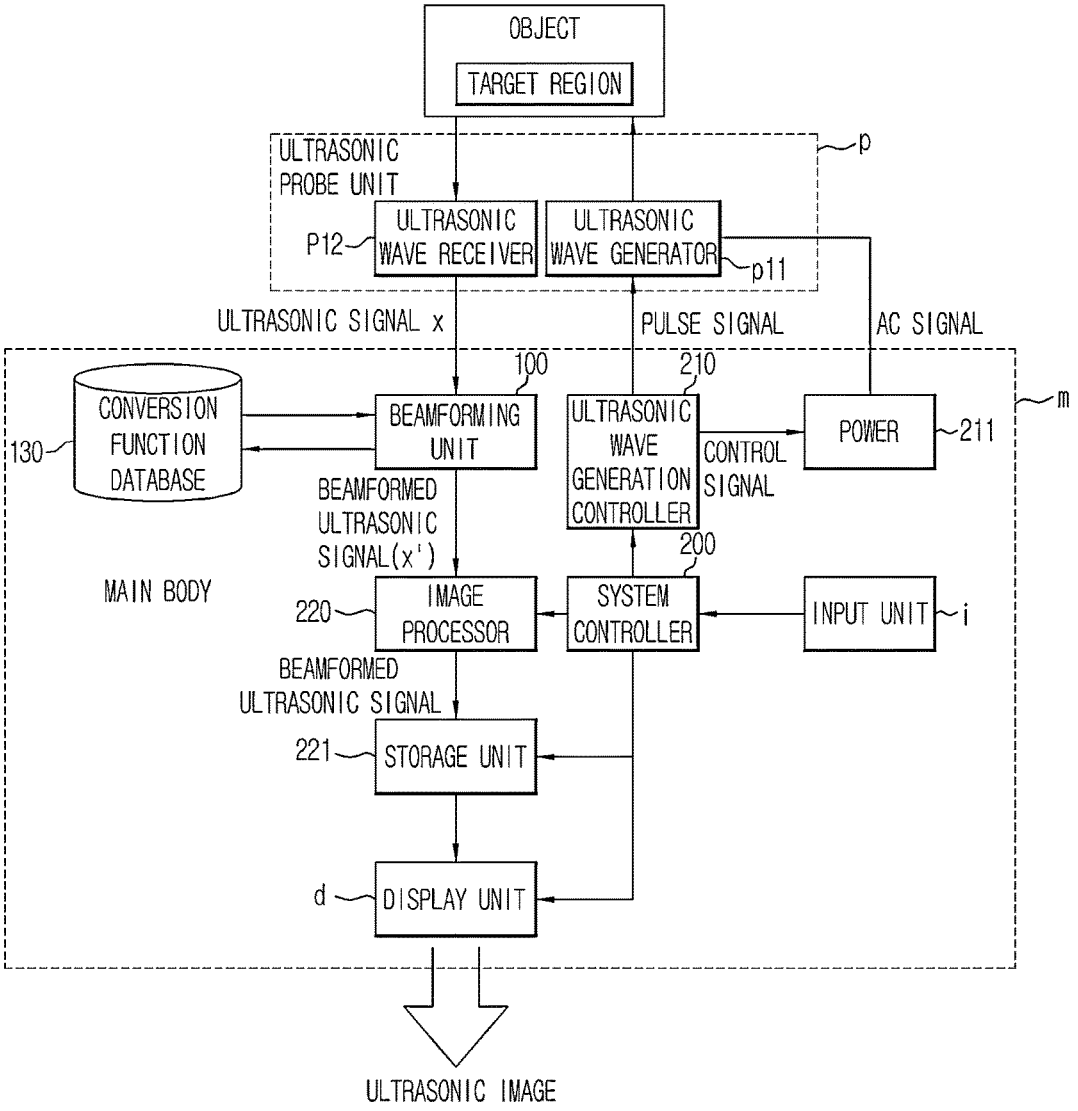
FIG. 5 is a block diagram illustrating an ultrasonic imaging apparatus according to an exemplary embodiment.

FIG. 4 is a perspective view illustrating an ultrasonic imaging apparatus according to an exemplary embodiment. FIG. 5 is a block diagram illustrating an ultrasonic imaging apparatus according to an exemplary embodiment.

Referring to FIGS. 4 and 5, an ultrasonic imaging apparatus includes an ultrasonic probe unit p that radiates ultrasonic waves to an object ob, receives ultrasonic echo signals from the object ob, and converts the received ultrasonic echo signals into electric signals, i.e., ultrasonic signals, and a main body m that generates an ultrasonic image based on the ultrasonic signals. The ultrasonic probe unit p may include a plurality of ultrasonic transducers p10 at an end thereof. As illustrated in FIG. 4, the ultrasonic probe unit p may be an ultrasonic probe of the ultrasonic imaging apparatus, and the main body m may be a workstation connected to the ultrasonic probe and including an input unit i and a display unit d. However, the ultrasonic probe unit p is not limited thereto. Any ultrasonic probe including various constituent elements to generate an ultrasonic image based on ultrasonic signals may be used. For example, an ultrasonic probe provided with a beamforming unit 100 or an image processor 220 illustrated in FIG. 7 may also be used. Hereinafter, however, an ultrasonic imaging apparatus including an ultrasonic probe unit p including an ultrasonic probe and a main body m that performs beamforming or image processing will be described for convenience of description.

As illustrated in FIG. 5, according to an exemplary embodiment, the ultrasonic imaging apparatus may include the ultrasonic probe unit p including an ultrasonic wave generator p11 and an ultrasonic wave receiver p12 and the main body m including a beamforming unit 100, a conversion function database 130, a system controller 200, an ultrasonic wave generation controller 210, a power source 211, an image processor 220, a storage unit 221, the input unit i, and the display unit d.

The ultrasonic probe unit p collects information regarding a target region ob1 of the object ob using ultrasonic waves.

Referring to FIG. 5, the ultrasonic probe unit p may include the ultrasonic wave generator p11 that generates ultrasonic waves and radiates the ultrasonic waves to the target region ob1 inside the object ob and the ultrasonic wave receiver p12 that receives ultrasonic echo signals from the object ob. The ultrasonic wave generator p11 generates ultrasonic waves in accordance with pulse signals or alternating signals controlled by the ultrasonic wave generation controller 210. The ultrasonic waves generated by the ultrasonic wave generator p11 are reflected from the target region ob1 inside the object ob. The ultrasonic wave receiver p12 receives the reflected ultrasonic waves, i.e., ultrasonic echo signals, and generates predetermined alternating current according to a frequency of the ultrasonic echo signals. As a result, ultrasonic signals x are generated.

Figure 6:
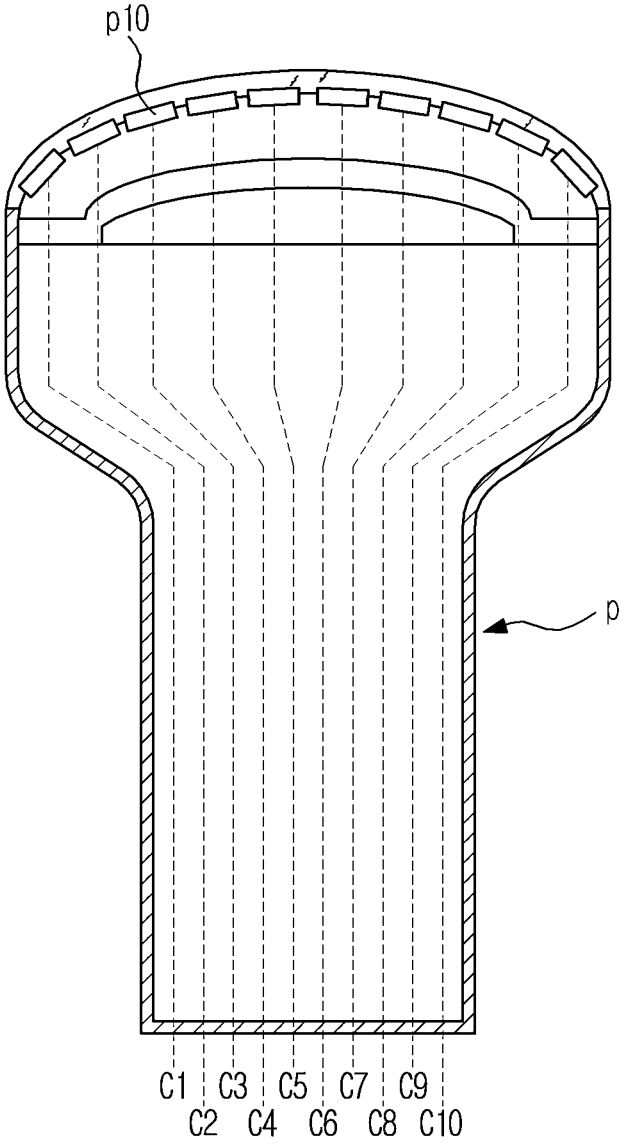
FIG. 6 is a plan view illustrating an ultrasonic probe unit according to an exemplary embodiment.

FIG. 6 is a plan view illustrating an ultrasonic probe unit p according to an exemplary embodiment. Referring to FIG. 6, the ultrasonic probe unit p may include a plurality of ultrasonic transducers p10 at an end thereof. The ultrasonic transducers p10 generate ultrasonic waves according to signals or power applied thereto, radiate the ultrasonic waves to the object ob, receive ultrasonic echo signals reflected from the object ob, and convert the ultrasonic echo signals into electric signals.

Particularly, the ultrasonic transducers p10 receive power from an external power supply or an internal capacitor, for example, a battery or the like, and a piezoelectric vibrator or a thin film of the ultrasonic transducers p10 vibrates according to the received power to generate ultrasonic waves. Also, upon receiving ultrasonic waves, a piezoelectric material or the thin film of the ultrasonic transducers p10 vibrates according to the received ultrasonic waves such that the ultrasonic transducers p10 generate alternating current corresponding to a vibration frequency to convert the received ultrasonic waves into electric signals x, i.e., ultrasonic signals. The ultrasonic transducers p10 transmit the generated ultrasonic signals x to the beamforming unit 100 (see FIG. 7) of the main body m through a plurality of channels C1 to C10 as illustrated in FIG. 6.

Various ultrasonic transducers may be used as the ultrasonic transducers p10. For example, magnetostrictive ultrasonic transducers using magnetostrictive effects of a magnetic substance, piezoelectric ultrasonic transducers using piezoelectric effects of a piezoelectric material, or capacitive micromachined ultrasonic transducers (cMUTs), which transmit and receive ultrasonic waves using vibration of several hundreds or several thousands of micromachined thin films, may be used. Any other transducers capable of generating ultrasonic waves according to input electric signals or generating electric signals according to input ultrasonic waves may also be used as the ultrasonic transducers p10.

As illustrated in FIG. 5, according to an exemplary embodiment, the ultrasonic probe unit p may separately include a ultrasonic wave generator, i.e., the ultrasonic wave generator p11, and a ultrasonic wave generator, i.e., the ultrasonic wave receiver p12. However, as illustrated in FIG. 6, the ultrasonic probe unit p may include at least one ultrasonic transducer p10 that performs functions of both of the ultrasonic wave generator p11 and the ultrasonic wave receiver p12. In other words, the ultrasonic wave generator p11 and the ultrasonic wave receiver p12 described with reference to FIG. 5 may be combined with each other.

The ultrasonic probe unit p may include 64 or 128 ultrasonic transducers p10 at one end thereof. Thus, the ultrasonic signals x may be transmitted through a plurality of channels, for example 64 or 128 channels, in the ultrasonic probe unit p.

The beamforming unit 100 of the main body m receives the ultrasonic signals x from the ultrasonic probe unit p and beamforms the ultrasonic signals x.

Figure 7:
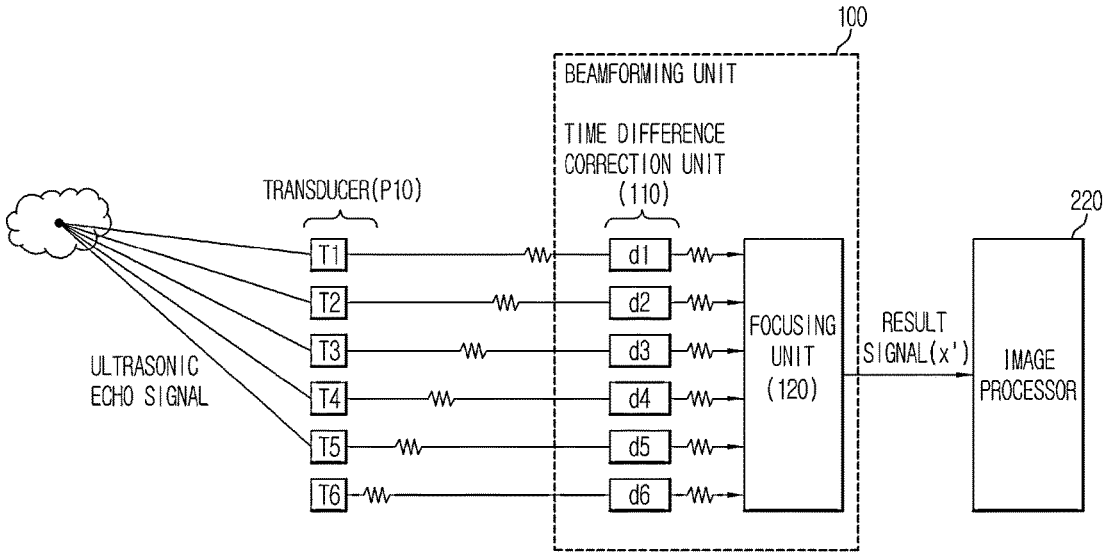
FIGS. 7 to 9 are diagrams for explaining a beamforming unit according to exemplary embodiments.

FIG. 7 is a diagram for explaining a beamforming unit according to an exemplary embodiment.

As illustrated in FIG. 7, ultrasonic echo signals reflected from the target region ob1 are received by the ultrasonic wave receiver p12, for example, of the ultrasonic transducers p10, as described above. Here, although the ultrasonic echo signals are reflected from the same target region ob1, the ultrasonic transducers p10of the ultrasonic probe unit p may receive the ultrasonic echo signals reflected from the same target region ob1 at different times. That is, a predetermined time difference may be present between arrival times of the ultrasonic echo signals reflected from the same target region ob1 at the ultrasonic transducers T1 to T6. This is because distances between the target region ob1 and each of the ultrasonic transducers T1 to T6 receiving the ultrasonic echo signals may not be the same. Thus, ultrasonic echo signals received by the ultrasonic transducers T1 to T6 at different times may be ultrasonic echo signals reflected from the same target region ob1. Accordingly, the time difference between the arrival times of the ultrasonic signals in the ultrasonic transducers T1 to T6 needs to be corrected.

A time difference correction unit 110 corrects an arrival time difference between the ultrasonic signals. For example, as illustrated in FIG. 7, the time difference correction unit 110 including a plurality of different correction units d1 to d6 may delay transmission of each of the ultrasonic signals x input through channels, respectively, to a predetermined level. Accordingly, the ultrasonic signals x input through the channels may arrive at a focusing unit 120 at substantially the same time.

The focusing unit 120 focuses the ultrasonic signals x, a time difference of which is corrected.

A beamforming process performed to extract a beamformed scan line in a related art ultrasonic imaging apparatus may be generally expressed by Equation 10 below.

$$z[n] = \sum_{m=0}^{M-1} w_m[n]x_m[n - \Delta_m[n]] \quad \text{[Equation 10]}$$

In Equation 10, n represents a value indicating a position of the target region ob1, and $w_m$ represents a beamforming coefficient w applied to an ultrasonic signal from the position n of the target region ob1 at an m-th channel. $\Delta_m$ is a delay time in transmitting an ultrasonic signal input through a predetermined channel. In other words, $x_m[n-\Delta_m[n]]$ indicates a time difference-corrected ultrasonic signal of the m-th channel.

When the input signal is a time difference-corrected signal, Equation 10 above may be rewritten as Equation 11.

$$x' = w^H x \quad \text{[Equation 11]}$$

That is, according to a general ultrasonic beamforming process, a focused ultrasonic signal x' is obtained by correcting a time difference between the ultrasonic signals x from each of the channels as shown in Equations 10 and 11 and applying predetermined weights to the time difference-corrected signals (x−Δx).

Figure 8:
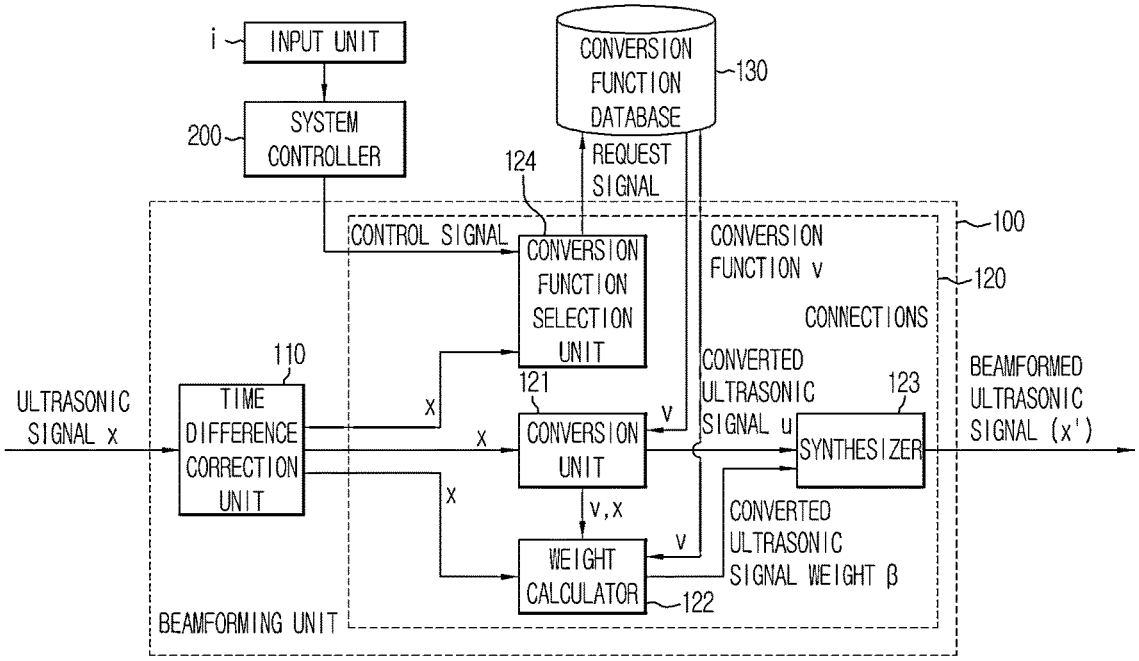
Figure 9:
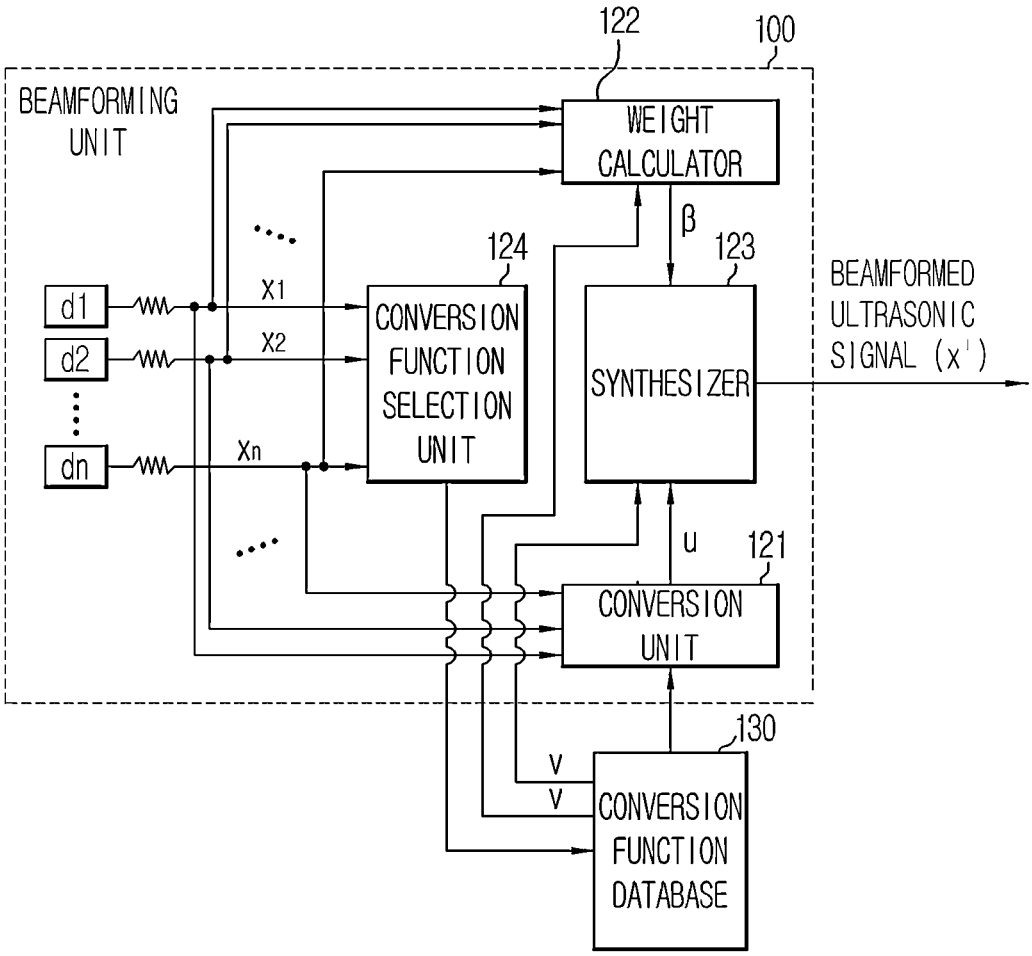

Hereinafter, the focusing unit 120 will be described in more detail with reference to FIGS. 8 and 9. FIGS. 8 and 9 are diagrams for explaining the beamforming unit 100 according to exemplary embodiments.

As illustrated in FIGS. 8 and 9, the focusing unit 120 may include a conversion unit 121, a weight calculator 122, a synthesizer 123, and a conversion function selection unit 124.

The conversion unit 121 receives a plurality of ultrasonic signals x, a time difference of which is corrected by the time difference correction unit 110, generates converted ultrasonic signals u by converting the input ultrasonic signals x, and transmits the generated converted ultrasonic signals u to the synthesizer 123 as illustrated in FIGS. 8 and 9. In this case, the conversion unit 121 may generate the converted ultrasonic signals u using a predetermined conversion function v. For example, the conversion unit 121 may calculate converted ultrasonic signals u by multiplying the ultrasonic signals x by a predetermined conversion function v. That is, the conversion unit 121 may calculate the converted ultrasonic signals u using Equation 1 above.

The conversion unit 121 may calculate the converted ultrasonic signals u using a conversion function v stored in a separate conversion function database 130. The conversion function database 130 is a database constructed using at least one function of pre-defined conversion functions $v_1$ to $v_n$ (not shown). According to an exemplary embodiment, the at least one conversion function v stored in the conversion function database 130 may be calculated in advance based on ultrasonic signals x with various shapes acquired theoretically or based on past experience. In this case, each of the conversion functions v may be calculated respectively corresponding to each of the ultrasonic signals x with various shapes. In addition, the conversion functions v stored in the conversion function database 130 may be basis vectors by that are acquired based on beamforming coefficients w calculated using the ultrasonic signals x, which are input or to be input, or may be a combination of a plurality of the basis vectors by. In this case, the basis vectors by may be orthogonal vectors that are substantially perpendicular to one another, for example, eigenvectors or Fourier basis vectors. According to an exemplary embodiment, the beamforming coefficients w calculated using the ultrasonic signals x that are input or to be input may be optimal beamforming coefficients w* obtained by applying a minimum variance technique to the ultrasonic signals x from a plurality of channels as illustrated in FIG. 9. In addition, the basis vector by acquired based on the beamforming coefficient w may be a basis vector obtained through a principle component analysis (PCA) performed upon the beamforming coefficient w or w*.

The weight calculator 122 calculates converted ultrasonic signal weights β to be applied to the converted ultrasonic signals u output from the conversion unit 121. In this case, the weight calculator 122 may calculate the converted ultrasonic signal weights β for the converted ultrasonic signals u by use of one of the ultrasonic signals x and the conversion function v or both. That is, as illustrated in FIG. 9, the weight calculator 122 may separately receive a plurality of ultrasonic signals x1, x2, . . . , xn input through a plurality of channels, of which time difference therebetween is corrected by a plurality of correction units d1 to dn, and read the conversion function database 130 to extract the conversion function v. The conversion function v extracted from the conversion function database 130 may be identical to or different from the conversion function v used in the conversion unit 121 to calculate the converted ultrasonic signals u depending on embodiments.

Particularly, the weight calculator 122 may calculate the converted ultrasonic signal weights β using Equation 4 or Equation 8 above. Thus, the converted ultrasonic signal weights β may vary according to the input ultrasonic signals x and the conversion function v used therefor. When the weight calculator 122 calculates the converted ultrasonic signal weights β, the steering vector shown in Equations 4 and 7 controls a phase of ultrasonic waves radiated to the target region ob1 of the object ob from the ultrasonic wave generator p11. When it is assumed that a time difference corrected by the time difference correction unit 110 is pre-corrected according to a direction, the steering vector a may be 1.

Based on the converted ultrasonic signals u and the converted ultrasonic signal weights β, the synthesizer 123 generates beamformed ultrasonic signals x'. The synthesizer 123 may generate the beamformed ultrasonic signals x using the weighted sum of the converted ultrasonic signals u and the converted ultrasonic signal weights R. In this case, according to an exemplary embodiment, the synthesizer 123 may calculate the beamformed ultrasonic signals x using Equation 9 above.

Equation 9 above may be rewritten as Equation 12 below.

$$x' = \beta^H u \quad \text{[Equation 12]}$$
$$= \beta^H V^H x$$
$$= (V\beta)^H x$$

When w is defined as in Equation 13, Equation 12 may be expressed as Equation 14 below.

$$w = V\beta \quad \text{[Equation 13]}$$

$$x' = \beta^H u = w^H x \quad \text{[Equation 14]}$$

Referring to Equation 14, it may be seen that the right side of Equation 14 is identical to that of Equation 11. That is, Equation 9 may also be expressed as Equation 11.

In other words, when the beamforming coefficient w is defined as Equation 13, the beamformed ultrasonic signal x' output from the synthesizer 123 using Equation 9 may be the same as a value acquired using the weighted sum of the ultrasonic signal x and a predetermined weight, i.e., the beamforming coefficient w.

Thus, the synthesizer 123 may output the same signal as the beamformed ultrasonic signal x' acquired by applying the beamforming coefficient w to the ultrasonic signal x.

Here, to directly calculate an optimal beamforming coefficient w' in accordance with the ultrasonic signal x according to an adaptive beamforming method, a conversion function v is selected based on the ultrasonic signal x, the ultrasonic signal x is projected onto a basis vector by of the selected conversion function v, a converted ultrasonic signal weight β is calculated using the projected ultrasonic signal x, and a final beamforming coefficient w is calculated by applying a weight β to the conversion function v. Thus, calculation time of beamforming increases, thereby increasing calculation load.

However, the same beamformed ultrasonic signal x' may be acquired using a simpler calculation process with less calculation time and load by use of the ultrasonic imaging apparatus including the focusing unit 120 which includes the conversion unit 121, the weight calculator 122, and the synthesizer 123 according to an exemplary embodiment.

The conversion function selection unit 124 selects the conversion function v used in one of the conversion unit 121 and the weight calculator 122 or both from the conversion function database 130. According to an exemplary embodiment, a system controller 200 may generate an appropriate control command according to pre-determined settings or a user selection input through the input unit i and transmit the control command to the conversion function selection unit 124. The conversion function selection unit 124 may select the conversion function v in accordance with the control command. One of the conversion unit 121 and the weight calculator 122 or both receive the conversion function v from the conversion function database 130 according to the selection of the conversion function selection unit 124 to calculate the converted ultrasonic signals u or the converted ultrasonic signal weights β and transmit the results to the synthesizer 123.

The focusing unit 120 may generate the beamformed ultrasonic signals x' based on the time difference-corrected ultrasonic signals x using the conversion unit 121, the weight calculator 122, and the synthesizer 123 as described above and output the beamformed ultrasonic signals x'. The beamformed ultrasonic signals x' output from the beamforming unit 100 are transmitted to the image processor 220 as illustrated in FIG. 7.

According to an exemplary embodiment, the ultrasonic imaging apparatus may include the image processor 220 that generates an image based on the beamformed ultrasonic signals x'. The image processor 220 generates an image such that a user, for example, a doctor or a patient, may visually examine an object, for example, internal organs of a human body based on the beamformed ultrasonic signal x'. That is, the image processor 220 generates an ultrasonic image using ultrasonic signals that are received by an ultrasonic receiver p12, for example, transducers p10, and beamformed by the beamforming unit 100 and transmits the ultrasonic image to the storage unit 221 or the display unit d.

In addition, according to an exemplary embodiment, the image processor 220 may perform additional image processing upon the ultrasonic image. For example, the image processor 220 may perform post-processing such as correction or re-adjustment of contrast, brightness, and sharpness of the ultrasonic image. According to a need, a particular region of the ultrasonic image may be emphasized. Furthermore, a plurality of ultrasonic images may be generated to form a 3-dimensional ultrasonic image. Such additional image processing of the image processor 220 may be performed in accordance with pre-determined settings or instructions or commands of a user input through the input unit i.

The storage unit 221 stores the ultrasonic image generated by the image processor 220 or the ultrasonic image on which post-processing has been performed, and displays the ultrasonic image on the display unit d upon, for example, a user's request.

The display unit d displays the ultrasonic image generated by the image processor 220 or stored in the storage unit 221 such that the user may visually recognize a structure or tissues inside the object ob.

The main body m of the ultrasonic imaging apparatus may include the ultrasonic wave generation controller 210. The ultrasonic wave generation controller 210 generates a pulse signal in accordance with a command from the system controller 200 or the like and transmits the pulse signal to the ultrasonic wave generator p11. The ultrasonic wave generator p11 generates ultrasonic waves according to the pulse signal and radiates the pulse signal to the object ob. In addition, the ultrasonic wave generation controller 210 may generate a separate control signal for the power source 211 to allow the power source 211 to apply predetermined alternating current to the ultrasonic wave generator p11.

The system controller 200 controls an overall operation of the ultrasonic imaging apparatus including the beamforming unit 100, the ultrasonic wave generation controller 210, the image processor 220, the storage unit 221, and the display unit d as described above.

According to an exemplary embodiment, the system controller 200 may control an operation of the ultrasonic imaging apparatus in accordance with pre-determined settings or a control command generated by instructions or commands of a user input through the input unit i.

The input unit i receives predetermined instructions or commands from the user to control the ultrasonic imaging apparatus. The input unit i may include a user interface such as, for example, a keyboard, a mouse, a trackball, a touch screen, or a paddle.

Figure 10:
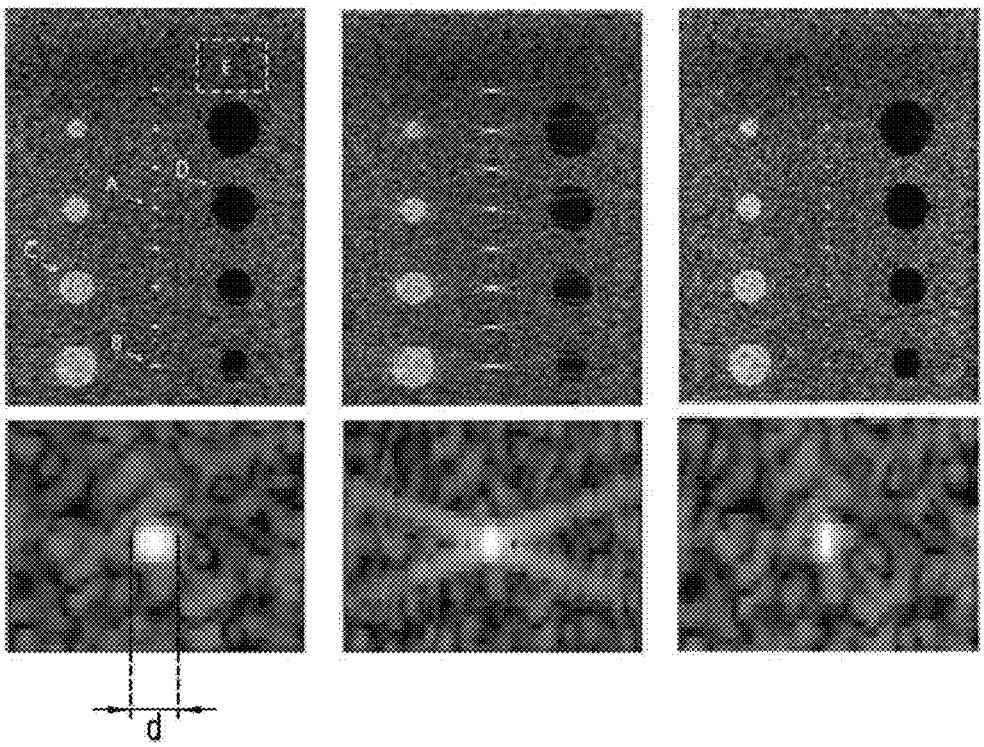
FIG. 10 illustrates ultrasonic images acquired according to related art techniques.
Figure 11:
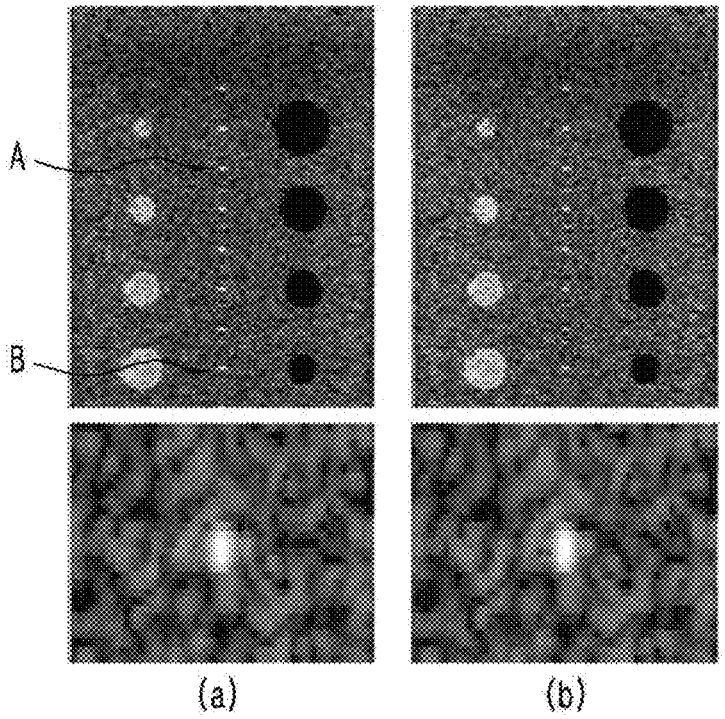
FIG. 11 illustrates ultrasonic images acquired by ultrasonic imaging apparatuses according to exemplary embodiments.

FIG. 10 illustrates ultrasonic images restored according to related art techniques. FIG. 11 illustrates ultrasonic images restored by ultrasonic imaging apparatuses according to exemplary embodiments as described above.

In FIGS. 10 and 11, upper images of ultrasonic images (a), (b), (c) are ultrasonic images of a brightness mode (B-mode), and lower images are enlarged images of a particular target region, for example, A, B, C, D, or E of the upper images. In FIGS. 10 and 11, a vertical axis of the upper images represents a depth of the target region ob1.

FIG. 10(*a*) illustrates a beamforming result obtained using a Hanning apodization method by which beamforming is performed using a Hann window. FIG. 10(*b*) illustrates a beamforming result obtained using a rectangular apodization method by which a beamforming is performed using rectangular apertures. The Hanning apodization method and the rectangular apodization method are data-independent beamforming methods. In addition, FIG. 10(*c*) illustrates an ultrasonic image acquired by minimum variance beamforming (or MV beamforming) that is an adaptive beamforming method.

As illustrated in FIGS. 10(*a*) to 10(*c*), images restored from the same target region ob1 may have different characteristics. For example, when the Hanning apodization method is used (FIG. 10(*a*)), contrast increases but resolution decreases. Thus, a width d of the target object ob1 of the lower image of FIG. 10(*a*) is greater than cases of using other methods. When the rectangular apodization method is used (FIG. 10(*b*)), resolution increases but contrast decreases compared to the Hanning apodization method. In addition, unique noise, i.e., X-shaped noise, as shown in the lower image of FIG. 10(*b*), is generated. The ultrasonic image restored according to the adaptive beamforming method illustrated in FIG. 10(*c*) has higher resolution and contrast. However, when the adaptive beamforming method is used, the beamforming coefficient w applied to the ultrasonic signal is not fixed but is variable according to the input ultrasonic signal. Accordingly, calculation load is greater than cases of using the Hanning apodization method and the rectangular apodization method.

FIG. 11(*a*) illustrates an image restored by focusing ultrasonic signals according to a method of modifying dimensions of the weight into two dimensions in the aforementioned ultrasonic imaging apparatus. In other words, the ultrasonic image is acquired using a beamforming process including selecting a conversion function v that reduces dimensions of the beamforming coefficient applied by the beamforming coefficient computation unit 41 to, for example, two dimensions, converting the ultrasonic signal x by use of the selected conversion function v, calculating a weight for the converted ultrasonic signal u, synthesizing the ultrasonic signal x and the weight.

In FIG. 11(*a*), although the dimensions of the beamforming coefficient are reduced to two dimensions, the ultrasonic image has improved resolution and contrast compared to the ultrasonic images restored using the Hanning apodization method and the rectangular apodization method as illustrated in FIG. 10(*a*) and FIG. 10(*b*). The ultrasonic image of FIG. 11(*a*) has higher resolution and contrast similar to those of the ultrasonic image restored according to the adaptive beamforming method illustrated in FIG. 10(*c*).

FIG. 11(*b*) is an ultrasonic image restored using a conversion function v that reduces the dimensions of the beamforming coefficient to three dimensions. The ultrasonic image of FIG. 11(*b*) also has improved resolution and contrast compared to the ultrasonic images restored using the Hanning apodization method and the rectangular apodization method as illustrated in FIG. 10(*a*) and FIG. 10(*b*). The ultrasonic image of FIG. 11(*b*) has higher resolution and contrast similar to those of the ultrasonic image restored according to the adaptive beamforming method illustrated in FIG. 10(*c*). Here, resolutions (measured in millimeters (mm)) at positions A and B illustrated in FIGS. 10 and 11 and in a case where the dimensions of the beamforming coefficient are reduced to four dimensions (not shown) are shown in Table 1 below.

TABLE 1

| | Position A | Position B | Average |
|---|---|---|---|
| Hanning apodization (FIG. 10 (a)) | 0.476 | 0.658 | 0.567 |
| Rectangular apodization (FIG. 10 (b)) | 0.295 | 0.385 | 0.340 |
| When reduced to two dimensions (FIG. 11(a)) | 0.159 | 0.295 | 0.227 |
| When reduced to three dimensions (FIG. 11(b)) | 0.159 | 0.181 | 0.170 |
| When reduced to four dimensions | 0.159 | 0.159 | 0.159 |
| Standard MV beamforming (FIG. 10(c)) | 0.159 | 0.159 | 0.159 |

Carrier-to-noise ratios (CNRs) (dB) at positions A and B illustrated in FIGS. 10 and 11 and in a case where the dimensions of the beamforming coefficient are reduced to four dimensions (not shown) are shown in Table 2 below.

TABLE 2

| | Hyperechoic | Anechoic | Average |
|---|---|---|---|
| Hanning apodization (FIG. 10(a)) | 2.698 | 2.107 | 2.403 |
| Rectangular apodization (FIG. 10(b)) | 2.720 | 1.346 | 2.033 |
| When reduced to two dimensions (FIG. 11(a)) | 2.736 | 2.097 | 2.417 |
| When reduced to three dimensions (FIG. 11(b)) | 2.726 | 2.134 | 2.430 |
| When reduced to four dimensions | 2.733 | 2.141 | 2.437 |
| Standard MV beamforming (FIG. 10(c)) | 2.719 | 2.157 | 2.438 |

Referring to Tables 1 and 2, the ultrasonic image of the ultrasonic imaging apparatus using the aforementioned beamforming unit 100 according to exemplary embodiments shows improved resolution compared to cases using a data-independent beamforming method. In addition, the resolution of the ultrasonic image obtained by the ultrasonic imaging apparatus according to exemplary embodiments is similar to that of the ultrasonic image restored according to the adaptive beamforming method. Thus, the ultrasonic imaging apparatus using the aforementioned beamforming unit 100 according to exemplary embodiments, which requires reduced calculation than adaptive beamforming, may restore the ultrasonic image to a level substantially equal to the ultrasonic image obtained according to the adaptive beamforming method.

Hereinafter, a beamforming method and a method of controlling the ultrasonic imaging apparatus according to exemplary embodiments will be described with reference to FIGS. 12 to 14.

Figure 12:
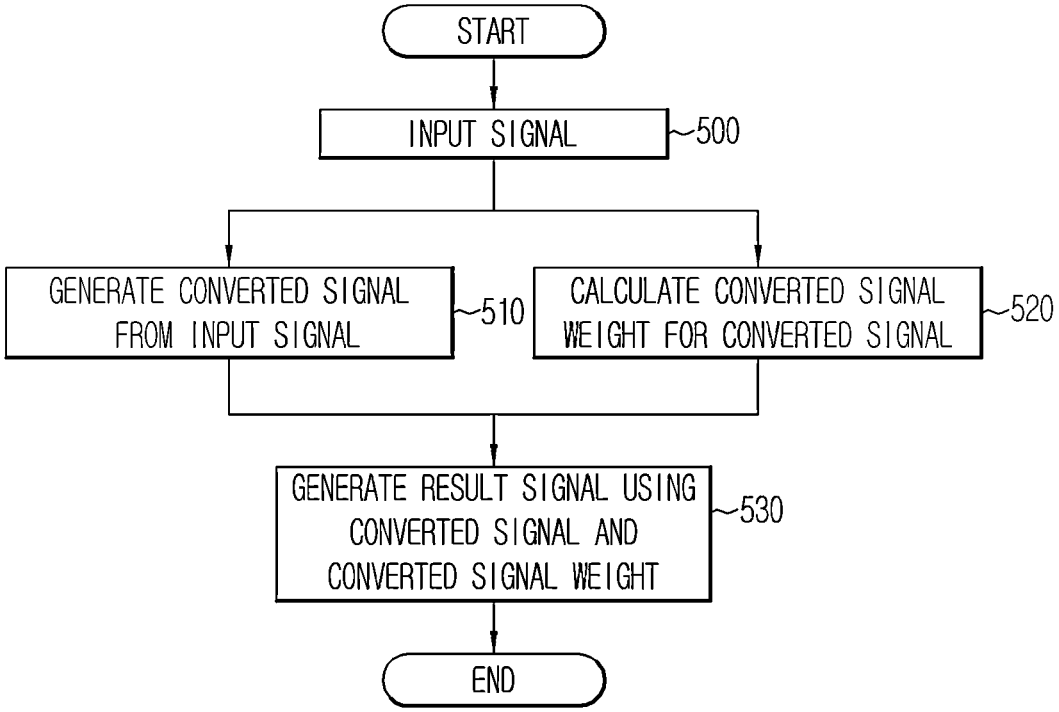
FIG. 12 is a flowchart illustrating a beamforming method according to an exemplary embodiment.

FIG. 12 is a flowchart illustrating a beamforming method according to an exemplary embodiment. As illustrated in FIG. 12, according to an exemplary embodiment, signals x to be beamformed are input to a beamforming module from an external device (S500). Next, the beamforming module generates converted signals u from the input signals x (S510). In this case, the converted signals u may be calculated and generated by multiplying the input signals x by the conversion function v using Equation 1.

Separately from calculation and generation of the converted signals u, converted signal weights β for the converted signals u are calculated (S520). The calculation of the converted signal weights β may be carried out independently or simultaneously or sequentially with calculation of the converted signals u. In this case, the calculation of the converted signal weights β may be performed using Equation 4 or 8.

The calculated converted signals u and converted signal weights β are synthesized to generate result signals x' (S530). In this case, Equation 9 above may be used.

Figure 13:
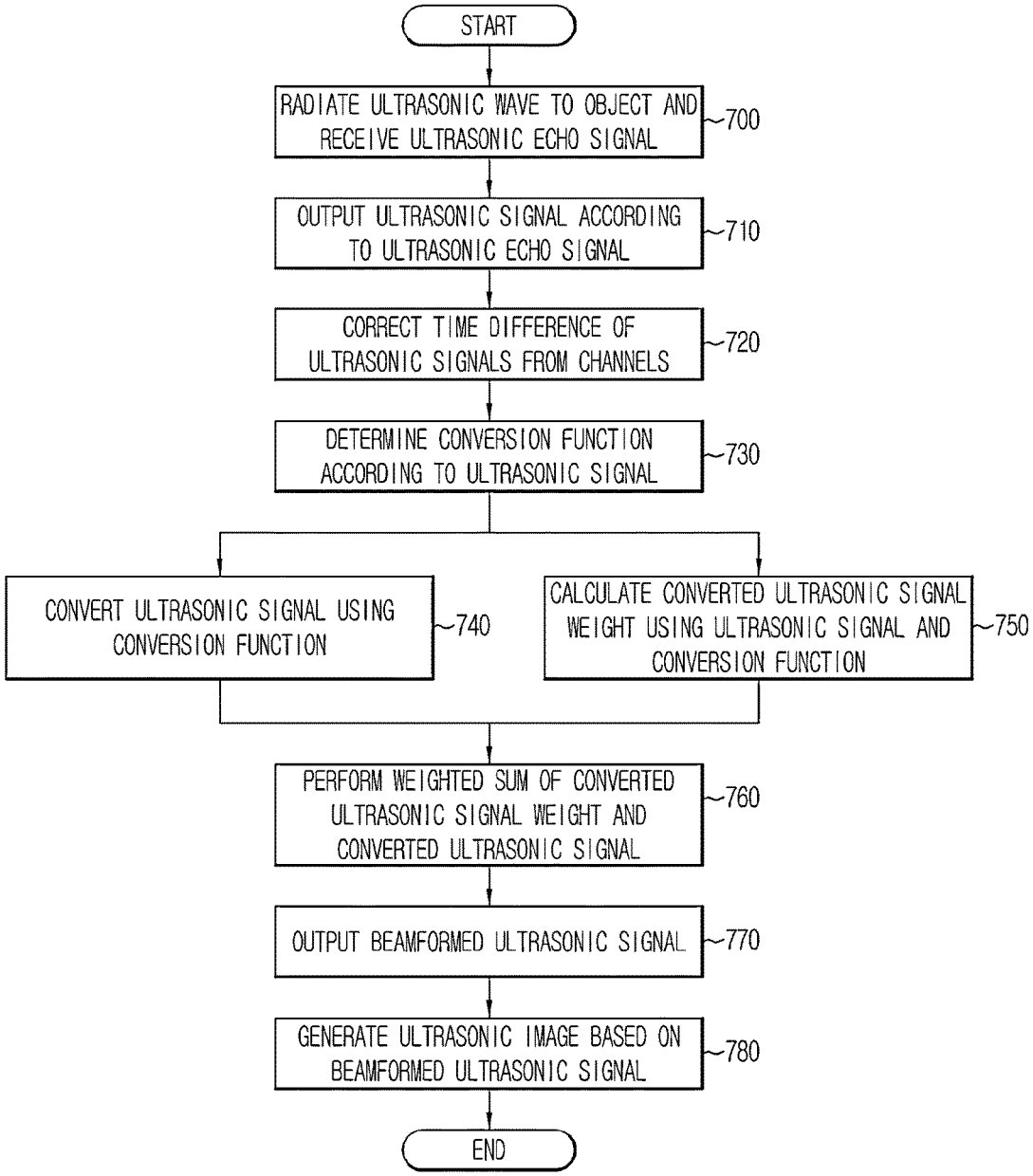
FIGS. 13 and 14 are flowcharts illustrating methods of controlling ultrasonic imaging apparatuses according to exemplary embodiments.

FIG. 13 is a flowchart illustrating a method of controlling an ultrasonic imaging apparatus according to an exemplary embodiment.

As illustrated in FIG. 13, according to the method of controlling the ultrasonic imaging apparatus according to an exemplary embodiment, ultrasonic waves are generated by power applied to the ultrasonic probe unit p and radiated to the target object ob1 of the object ob. The ultrasonic probe unit p receives ultrasonic echo signals that are reflected from the target object ob1 (S700). The ultrasonic probe unit p converts the received ultrasonic echo signals into electric signals and outputs ultrasonic signals x corresponding to the ultrasonic echo signals through a plurality of channels (S710).

When the ultrasonic signals x are output through the plurality of channels, a time difference between the ultrasonic signals x from respective channels is corrected by use of, for example, a time delay (S720).

Next, a predetermined conversion function for the time difference-corrected ultrasonic signal x is determined (S730). The predetermined conversion function may be a pre-defined conversion function v. In this case, the conversion function v may be a conversion function v retrieved from the conversion function database 130.

The ultrasonic signals x are converted using the conversion function v (S740). The aforementioned Equation 1 may be used to convert the ultrasonic signals x.

Converted ultrasonic signal weights β are calculated according to the ultrasonic signals x and the conversion function v (S750). In this case, the aforementioned Equation 4 or 8 may be used.

Next, the converted ultrasonic signal weights β and the converted ultrasonic signals u are respectively synthesized. In this case, as expressed in Equation 9, a weighted sum of the converted ultrasonic signal weights β and the converted ultrasonic signals u may be used (S760).

As a result of synthesis, beamformed ultrasonic signals x are generated and output (S770).

Next, an ultrasonic image is generated based on the output beamformed ultrasonic signals x, and the generated ultrasonic image is displayed through the display unit d (S780). Thus, an ultrasonic image restored using the method of controlling the ultrasonic imaging apparatus according to an exemplary embodiment may be viewed by a user.

Figure 14:
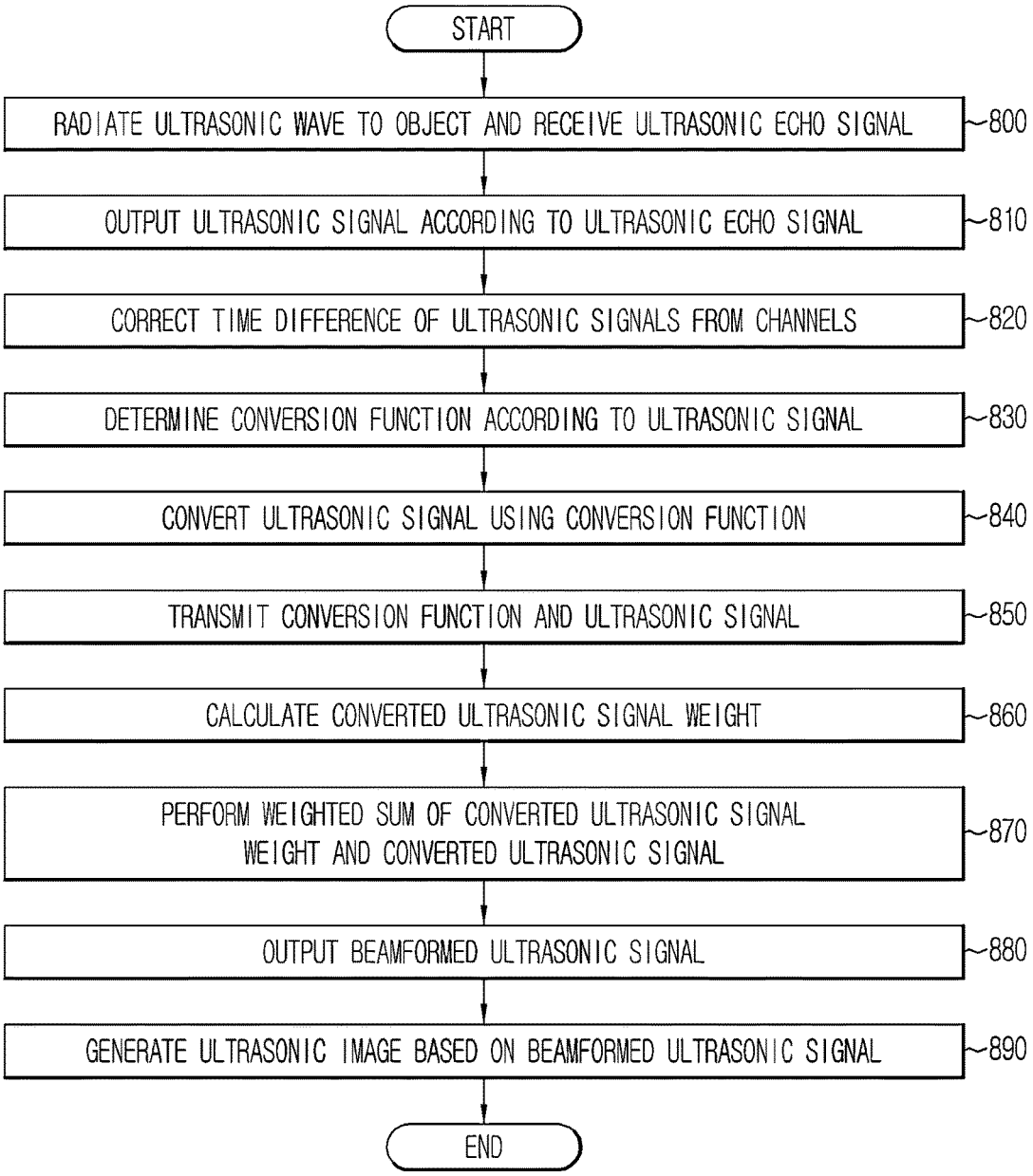

FIG. 14 is a flowchart illustrating a method of controlling an ultrasonic imaging apparatus according to another exemplary embodiment.

As illustrated in FIG. 14, according to the method of controlling the ultrasonic imaging apparatus according to another exemplary embodiment, the ultrasonic probe unit p receives ultrasonic echo signals that are reflected from the target object ob1 (S800) similarly to the aforementioned method. In accordance with the received ultrasonic echo signals, ultrasonic signals x are output via a plurality of channels (S810).

Next, a time difference between the ultrasonic signals x from respective channels is corrected by the use of the time difference correction unit 110 of the beamforming unit 100 using, for example, a time delay (S820).

The conversion function selection unit 124 selects a conversion function v corresponding to the time difference-corrected ultrasonic signals x (S830). The conversion unit 121 converts the ultrasonic signals x by use of the conversion function v to generate converted ultrasonic signals u (S840). In this case, the conversion unit 121 may convert the ultrasonic signals x using Equation 1. Next, the conversion unit 121 transmits the conversion function v used to convert the ultrasonic signals x and the time difference-corrected ultrasonic signals x to the weight calculator 122 and the synthesizer 123 (S850).

The weight calculator 122 calculates converted ultrasonic signal weights β using the received conversion function v and the ultrasonic signals x (S860). Equations 4 and 8 above may be used for calculation of the converted ultrasonic signal weights β. The calculated converted ultrasonic signal weights β are transmitted to the synthesizer 123.

The synthesizer 123 synthesizes the converted ultrasonic signals u received from the conversion unit 121 and the converted ultrasonic signal weights β received from the weight calculator 122 by use of a weighted sum according to Equation 9 (S870) to generate and output beamformed ultrasonic signals x' (S880).

The image processor 220 generates an ultrasonic image based on the output beamformed ultrasonic signals x and displays the ultrasonic image on the display unit d (S890). As a result, an ultrasonic image restored using the method of controlling the ultrasonic imaging apparatus according to another exemplary embodiment may be viewed by a user.

As described above, according to a beamforming module, an ultrasonic imaging apparatus, a beamforming method, and a method of controlling the ultrasonic imaging apparatus according to exemplary embodiments, calculation load required to beamform input signals may be reduced. Thus, resources required for beamforming in a variety of apparatuses, for example, ultrasonic imaging apparatuses may be reduced.

In addition, since input signals may be beamformed more quickly, beamforming time may be reduced.

In addition, a time-delayed output of an ultrasonic image may be prevented in a beamforming device, and overload or overheating of the beamforming device may also be prevented.

With reduction in the resources for beamforming, power consumption of the beamforming device may be reduced. Also, costs may be reduced by using a lower performance calculation device.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An ultrasonic imaging apparatus comprising:

an ultrasonic probe configured to output an input signal based on an ultrasonic echo signals; and a beam-former configured to:

convert the input signal to generate a converted signal using a first conversion function;

calculate a converted signal weight for the converted signal using the input signal and a second conversion function, by performing:

obtaining a covariance of the input signal;

obtaining a converted covariance using the covariance of the input signal and the second conversion function;

obtaining a converted steering vector using the second conversion function; and obtaining the converted signal weight for the converted signal using the converted covariance and the converted steering vector, wherein the converted signal weight is variably determined depending on the input signal; and generate a result signal using the converted signal and the converted signal weight, wherein the second conversion function is identical to the first conversion function.

2. The ultrasonic imaging apparatus according to claim 1, wherein the converted signal weight is a weight applied to the first conversion function to calculate an optimal input signal weight for the input signal.

3. The ultrasonic imaging apparatus according to claim 1, wherein the beam-former calculates the converted signal weight for the converted signal using Equation 1 below:

$$\beta = \frac{R_1^{-1} v_1}{v_1^H R_1^{-1} v_1} \quad \text{Equation 1}$$

wherein β represents the converted signal weight, $R_1$ represents a covariance of the converted signals, and $v_1$ represents a steering vector.

4. The ultrasonic imaging apparatus according to claim 3, wherein the covariance $R_1$ is a converted covariance of the input signals obtained using Equation 2 below:

$$R_1 = V^H R V \quad \text{Equation 2}$$

wherein V represents the first conversion function and R represents a covariance of the input signals.

5. The ultrasonic imaging apparatus according to claim 3, wherein the steering vector $v_1$ is a converted steering vector obtained using the first conversion function V.

6. The ultrasonic imaging apparatus according to claim 1, wherein the converted signal is generated using Equation 3 below:

$$u = V^H x \quad \text{Equation 3}$$

wherein u represents the converted signal, V represents the first conversion function, and x represents the input signal.

7. The ultrasonic imaging apparatus according to claim 6, wherein the result signal is acquired using Equation 4 below:

$$z = \beta^H u \quad \text{Equation 4}$$

wherein u represents the converted signal and β represents the converted signal weight calculated using Equation 1 below:

$$\beta = \frac{R_1^{-1} v_1}{v_1^H R_1^{-1} v_1} \quad \text{Equation 1}$$

wherein $R_1$ represents a converted covariance of the input signals, and $v_1$ represents a converted steering vector.

8. The ultrasonic imaging apparatus according to claim 1, wherein the first conversion function is generated by combination of basis vectors acquired by performing principle component analysis on an optimal input signal weight for the input signal, the optimal input signal weight being calculated through a minimum variance technique.

9. The ultrasonic imaging apparatus according to claim 1, wherein the first conversion function reduces dimensions of the input signal.

10. The ultrasonic imaging apparatus according to claim 1, wherein the first conversion function is generated based on at least one orthogonal basis vector.

11. The ultrasonic imaging apparatus according to claim 10, wherein the at least one orthogonal basis vector is at least one from among an eigenvector or a Fourier basis vector.

12. A method for controlling an ultrasonic imaging apparatus comprising:

receiving an ultrasonic echo signal;

output an input signal corresponding to the ultrasonic echo signal;

converting an input signal to generate a converted signal using a first conversion function;

calculating a converted signal weight for the converted signal by using the input signal and a second conversion function; and generating a result signal using the converted signal and the converted signal weight, wherein the calculating the converted signal weight comprises:

obtaining a covariance of the input signal;

obtaining a converted covariance using the covariance of the input signal and a second conversion function;

obtaining a converted steering vector using the second conversion function; and obtaining the converted signal weight for the converted signal using the converted covariance and the converted steering vector, wherein the converted signal weight is variably determined depending on the input signal, and wherein the second conversion function is identical to the first conversion function.

13. The method according to claim 12, wherein the converted signal weight is a weight applied to the first conversion function to calculate an optimal input signal weight for the input signal.

14. The method according to claim 12, wherein the calculating comprises calculating the converted signal weight for the converted signal using Equation 1 below:

Equation 1

$$\beta = \frac{R_1^{-1} v_1}{v_1^H R_1^{-1} v_1} \quad \text{Equation 1}$$

wherein β represents the converted signal weight, $R_1$ represents a covariance of the converted signals, and $v_1$ represents a steering vector.

15. The method according to claim 14, wherein the covariance $R_1$ is a converted covariance of the input signals obtained using Equation 2 below:

$$R_1 = V^H R V \quad \text{Equation 2}$$

wherein V represents the first conversion function and R represents a covariance of the input signals.

16. The method according to claim 14, wherein the steering vector $v_1$ is a converted steering vector obtained using the first conversion function v.

17. The method according to claim 12, wherein the converted signal is generated using Equation 3 below:

$$u = V^H x \quad \text{Equation 3}$$

wherein u represents the converted signal, V represents the first conversion function, and x represents the input signal.

18. The method according to claim 17, wherein the result signal is acquired using Equation 4 below:

$$z = \beta^H u \quad \text{Equation 4}$$

wherein u represents the converted signal and β represents the converted signal weight calculated using Equation 1 below:

$$\beta = \frac{R_1^{-1} v_1}{v_1^H R_1^{-1} v_1} \quad \text{Equation 1}$$

wherein $R_1$ represents a converted covariance of the input signals, and $v_1$ represents a converted steering vector.

* * * * *